US007095395B2

(12) United States Patent
Bu

(10) Patent No.: US 7,095,395 B2
(45) Date of Patent: Aug. 22, 2006

(54) GAMMA CORRECTION APPARATUS FOR A LIQUID CRYSTAL DISPLAY

(75) Inventor: Lin-Kai Bu, Tainan (TW)

(73) Assignee: Himax Technologies, Inc., Tainan (TW)

( * ) Notice: Subject to any disclaimer, the term of this patent is extended or adjusted under 35 U.S.C. 154(b) by 392 days.

(21) Appl. No.: 10/606,789

(22) Filed: Jun. 27, 2003

(65) Prior Publication Data

US 2004/0075674 A1 Apr. 22, 2004

(30) Foreign Application Priority Data

Oct. 21, 2002 (TW) ..... 91124225 A

(51) Int. Cl.
*G09G 3/36* (2006.01)
*G09G 5/10* (2006.01)

(52) U.S. Cl. ..... 345/89; 345/690

(58) Field of Classification Search ..... 345/88, 345/204, 690, 211
See application file for complete search history.

(56) References Cited

U.S. PATENT DOCUMENTS 5,993,199 A 11/1999 Safarik
6,359,389 B1 3/2002 Medina et al.
6,437,716 B1 8/2002 Nakao
6,727,874 B1 * 4/2004 Okuzono ..... 345/89
2002/0060656 A1 5/2002 Okuzono
2002/0063666 A1 5/2002 Kang et al.

FOREIGN PATENT DOCUMENTS

EP 0 947 975 A1 10/1999

* cited by examiner

*Primary Examiner*—Xiao Wu
*Assistant Examiner*—Stephen Sherman
(74) *Attorney, Agent, or Firm*—Rabin & Berdo, P.C.

(57) ABSTRACT

A gamma correction apparatus set in a liquid crystal display (LCD), comprising a gray-scale voltage generating circuit and a gamma correction circuit. The gray-scale voltage generating circuit includes the common gray-scale voltage generating circuit and a plurality of individual gray-scale voltage generating circuits, wherein every individual gray-scale voltage generating circuit generates individual gray-scale voltage and corresponds to one of the displaying colors of the pixels of the LCD panel. The gamma correction circuit, according to the corresponding color of the pixel signal, selects the common gray-scale voltage and the corresponding individual gray-scale voltages of the color, and then outputs a pixel voltage corresponding to the pixel signal.

29 Claims, 16 Drawing Sheets

GAMMA CORRECTION APPARATUS FOR A LIQUID CRYSTAL DISPLAY

This application claims the benefit of Taiwan application Serial No. 091124225, filed Oct. 21, 2002.

BACKGROUND OF THE INVENTION

1. Field of the Invention

The invention relates in general to a digital analog signal converting apparatus, and more particularly, to a gamma correction apparatus for a liquid crystal display.

2. Description of the Related Art

Featuring the favorable advantages of thinness, lightness, and low electromagnetic radiation, liquid crystal displays (LCDs) have been widely used nowadays.

An LCD panel includes a plurality of pixels arranged in matrix form. Each pixel is composed of an upper plate, a lower plate and a liquid crystal layer set between the lower plate and the upper plate. When the potential difference between the upper plate voltage and the lower plate voltage changes, the liquid crystal molecular arrangement of the liquid crystal layer will change accordingly. As a result, the pixel luminance is affected. Therefore, the luminance of the pixels of an LCD can be controlled by adjusting the magnitude of voltages applied to the lower plate and the upper plate respectively. The difference between the upper plate voltage and the lower plate voltage is called the "gray-scale voltage".

Please refer to FIG. 1, a diagram of gamma curve illustrating the relationship between pixel voltage and pixel luminance. As illustrated in FIG. 1, the relationship between pixel voltage and pixel luminance is nonlinear. In addition, pixel luminance is related to the magnitude of pixel voltage but is not related to the polarity of pixel voltage. The gamma curve, thus, is symmetrical to the Y-axis, with a positive polarity gamma curve 102 and a negative polarity gamma 104 on the both sides of the Y-axis. According to the gamma curve, when pixel voltages of the same magnitude are individually applied to a pixel, the pixel will generate the same level of luminance regardless of the polarity of the pixel voltage. If it is desired to display a pixel at the same luminance over a long period of time, the liquid crystal molecules can be protected by alternating the polarity of the pixel voltage applied to the pixel.

Normally, pixel signals are binary digital signals. Since the gamma curve relationship between pixel voltage and pixel luminance is non-linear, the LCD needs a particular circuit to convert digital pixel signals into corresponding pixel voltages according to the gamma curve relationship and to output the pixel voltages to achieve a linear relationship between pixel signal and pixel luminance. This conversion is called "gamma correction", which is used to improve the display quality of an LCD panel.

Please refer to FIG. 2, a schematic diagram illustrating the theory of gamma correction. When executing gamma correction, first of all, a plurality of pixel signals are selected as reference pixel signals. In FIG. 2, pixel signals D0, D1, D2, D3, and D4 are selected as reference pixel signals. According to the gamma curve, each reference pixel signal corresponds to a positive polarity reference voltage and a negative polarity reference voltage respectively. Take pixel signal D0 for example; D0 corresponds to positive polarity reference voltage V0 and negative polarity reference voltage V9 respectively. By the same analogy, reference pixel signals D0, D1, D2, D3, and D4 respectively correspond to five positive polarity reference voltages V0, V1, V2, V3, and V4, and five negative polarity reference voltages V9, V8, V7, V6, and V5 as shown in FIG. 2. During gamma correction, the corresponding pixel voltages of other pixel signals can be obtained via interpolation based on the relationship between the reference pixel signals and reference voltages. Each pixel corresponds to a positive polarity pixel voltage and a negative pixel voltage respectively.

It is noteworthy that the more pixel signals are selected for gamma correction, the more accurate the corresponding pixel voltage of each pixel signal estimated will be. Normally 8 pixel signals are selected for the execution of gamma correction. According to the gamma curve, 8 pixel signals correspond to 8 positive polarity reference voltages and 8 negative reference voltages respectively. The gamma correction device thus executes gamma correction based on the 16 reference voltages.

Please refer to FIG. 3, a schematic diagram for a conventional gray-scale voltage generating circuit. Normally, pixel signals, denoted by DATA, are signals of 8-bit binary data which can represent at most 256 gray levels. Therefore, a gray-scale voltage generating circuit 300 needs to be set in the gamma correction device to output 256 positive polarity gray-scale voltages and 256 negative polarity gray-scale voltages according to inputted reference voltages, wherein each gray-scale voltage corresponds to a pixel signal DATA. gray-scale voltage generating circuit 300 is composed of two series of resistors for outputting positive polarity gray-scale voltages and negative gray-scale voltages respectively. Each series of resistors have 255 resistors, numbered as R0, R1, . . . , R254; a plurality of input nodes for the input of corresponding reference voltage signals V0 to V4 and V5 to V9; and 256 output nodes for outputting gray-scale voltages. According to voltage dividing rule, by setting appropriate resistance value of each resistor in the two series of resistors, the corresponding gray-scale voltage of each of the digital pixel signals DATA can be outputted from each output nodes in the two series of resistors.

Please refer to FIGS. 4A to 4G, diagrams illustrating gamma curves of various patterns. To make the diagrams simpler and clearer, FIGS. 4A to 4G illustrate only part of the gamma curve with the remaining part of corresponding complete gamma curves left to be inferred from the illustrated part in FIGS. 4A to 4G. According to what color is to be displayed, three kinds of pixel signals corresponding to the red, green and blue colors are employed to control the luminance of the red, green and blue pixels respectively in a color LCD. In FIGS. 4A to 4G, the three gamma curves labeled R, G and B represent the gamma curve relationship between the luminance of a pixel and the gray-scale voltage of the pixel when the pixel is used to display the red, green, and blue colors respectively. The gamma curve relationship between the gray-scale voltage applied to the pixel and pixel luminance changes when the conformation of the pixel's liquid crystal molecules changes. The possible patterns of the gamma curve are illustrated in FIGS. 4A to 4G.

In FIG. 4A, as the pixel voltages applied to pixels of different colors approach their maxima, the luminance difference between the pixels of different colors turns larger. FIG. 4B shows that as the pixel voltages applied to pixels of different colors approach their minima, luminance difference between the pixels of different colors turns larger. FIG. 4C, a mixture of FIGS. 4A and 4B, shows that whatever the pixel voltages applied to pixels approach their maxima or minima, luminance difference between the pixels of different colors turns larger. FIG. 4D is similar to FIG. 4A except that when the pixel voltage applied to the pixel reaches its maximum, the liquid crystal molecules will have the same light transmittance no matter what color the pixel displays. FIG. 4E is similar to FIG. 4B except that when the pixel voltage applied to a pixel reaches its minimum, the light transmittance of the liquid crystal molecules will be the same no matter what color the pixel displays. FIG. 4F is similar to FIG. 4C except that when the pixel voltage applied to a pixel reaches whatever its maximum or minimum, the light transmittance of the liquid crystal molecules will be the same no matter what color the pixel displays. FIG. 4G shows that the luminance difference between pixels of different colors turns smaller as the pixel voltages applied to the pixels approach their minima or maxima, but turns larger as the pixel voltages are getting closer to middle values. The gamma curve of an ordinary TN mode LCD panel is basically the same as the gamma curve shown in FIG. 4A, while the gamma curve of an ordinary VA mode LCD panel is basically the same as the gamma curve shown in FIG. 4B.

It can be understood from FIGS. 4A to 4G that patterns of gamma curve vary with the conformation of the liquid crystal molecules in an LCD panel. However, they share one common characteristic: the gamma curve changes when the displaying color of the pixel changes.

When executing gamma correction, the conventional gamma correction device determines the relationship between the pixel signal and the reference voltage according to an already established gamma curve disregarding what color the corresponding pixel of each pixel signal displays, thereby determining the magnitude of the corresponding pixel voltage of each pixel signal. This method avoids the circuit of the gamma correction device becoming too complicated and prevents the drive circuit of the gamma correction device from occupying too large a space. However, the conventional method is disadvantaged by failing to execute gamma correction of pixel signals with respect to the colors of the pixels to which the pixel signals are to be applied. In this way, a linear relationship between the pixel signal and the pixel luminance, as well as the maximum luminance, under certain circumstances, can not be obtained. Therefore, the display quality of the LCD panel is affected.

SUMMARY OF THE INVENTION

It is therefore an object of the invention to provide a gamma correction device executing gamma correction of pixel signals according to different gamma curves with respect to different colors of pixels. In this way, a linear relationship between the pixel signal and the pixel luminance can be obtained no matter what color a pixel displays, thus improving the display quality of LCDs.

It is therefore an object of the invention to provide a gamma correction apparatus for outputting the corresponding pixel voltage of a pixel signal for an LCD. The gamma correction device includes a gray-scale voltage generating circuit and a gamma correction circuit. The gray-scale voltage generating circuit includes a common gray-scale voltage generating circuit for generating a plurality of common gray-scale voltages, and a plurality of individual gray-scale voltage generating circuits, coupled to the common gray-scale voltage, for generating a plurality of individual gray-scale voltages. In a color LCD panel, pixels can be used to display the red, the blue and the green colors. While each individual gray-scale voltage generating circuit corresponds to one of the three colors mentioned above, the value of each individual gray-scale voltage generated by each individual gray-scale voltage generating circuit is determined according to what color the individual gray-scale voltage generating circuit corresponds to. The gamma correction circuit, coupled to the gray-scale voltage generating circuit, is used for outputting the corresponding pixel voltage of the pixel signal according to the common gray-scale voltages and the individual gray-scale voltages. If the pixel signal is used to display the red color, the gamma correction circuit will output the corresponding pixel voltage of the pixel signal according to the common gray-scale voltages and the red gray-scale voltages. If the pixel signal is used to display the green color, the gamma correction circuit will output the corresponding pixel voltage for the pixel signal according to the common gray-scale voltages and the green gray-scale voltages. If the pixel signal is used to display the blue color, the gamma correction circuit will output the corresponding pixel voltage for the pixel signal according to the common gray-scale voltages and the blue gray-scale voltages.

Other objects, features, and advantages of the invention will become apparent from the following detailed description of the preferred but non-limiting embodiments. The following description is made with reference to the accompanying drawings.

DETAILED DESCRIPTION OF THE INVENTION

The feature of the present invention is that for the part of gamma curve where large difference exists between gamma curves for different colors, the values of gray-scale voltages generated by the gray-scale voltage generating circuit and their corresponding relationship with the pixel signal are determined according to respective gamma curve for respective colors. During gamma correction, the pixel signal and the value of gray-scale voltage will have a linear relationship no matter what color the pixel signal corresponds to, thereby improving the display quality of the LCD panel.

Figure 1:
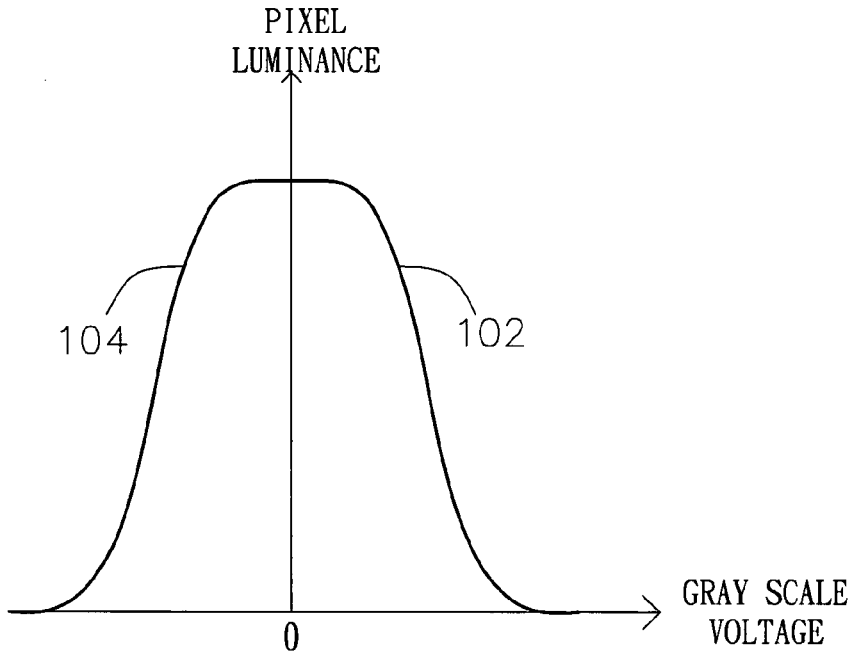
FIG. 1(PRIOR ART)
FIG. 1 (Prior Art) is a diagram of gamma curve illustrating the relationship between pixel voltage and pixel luminance.
Figure 2:
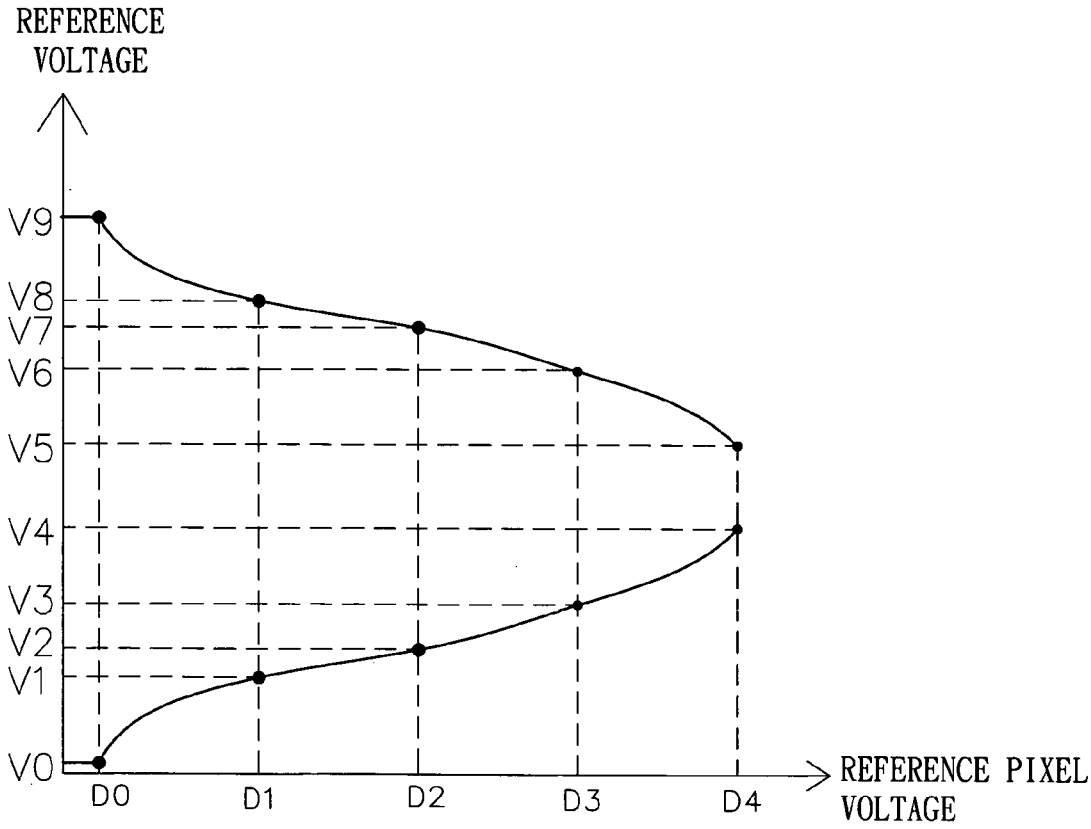
FIG. 2(PRIOR ART)
FIG. 2 (Prior Art) is a schematic diagram illustrating the theory of gamma correction.
Figure 3:
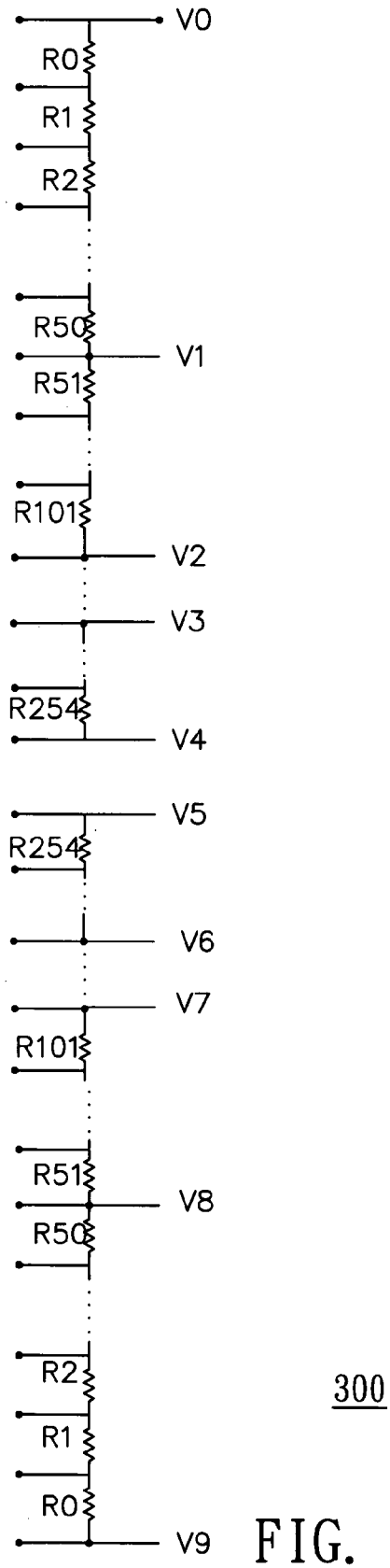
FIG. 3(PRIOR ART)
FIG. 3 (Prior Art) is a schematic diagram for a conventional gray-scale voltage generating circuit.
Figure 4A:
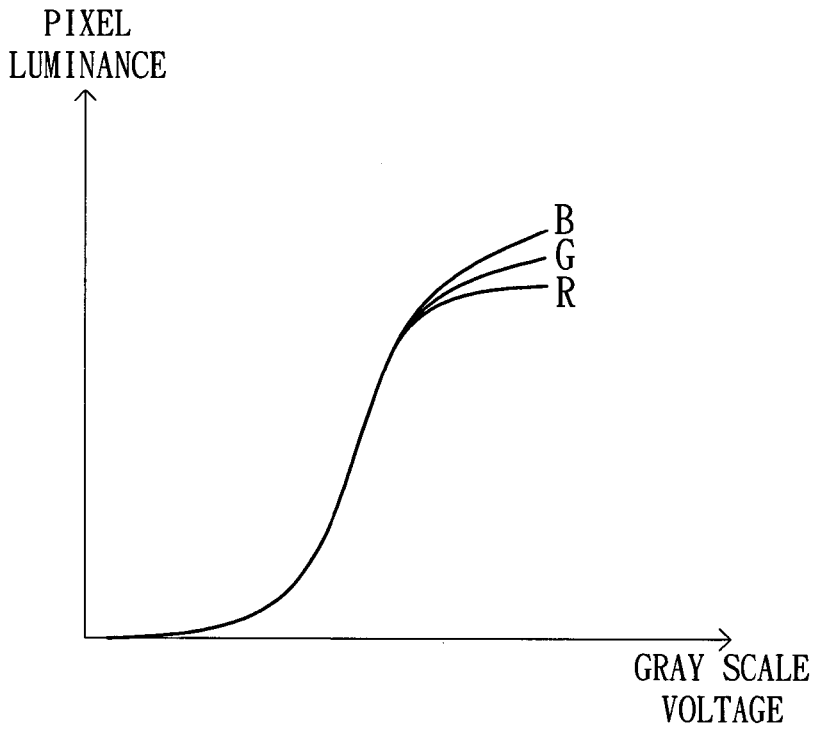
FIG. 4A (PRIOR ART)
FIGS. 4A to 4G (Prior Art) illustrate gamma curves of various patterns.
Figure 4B:
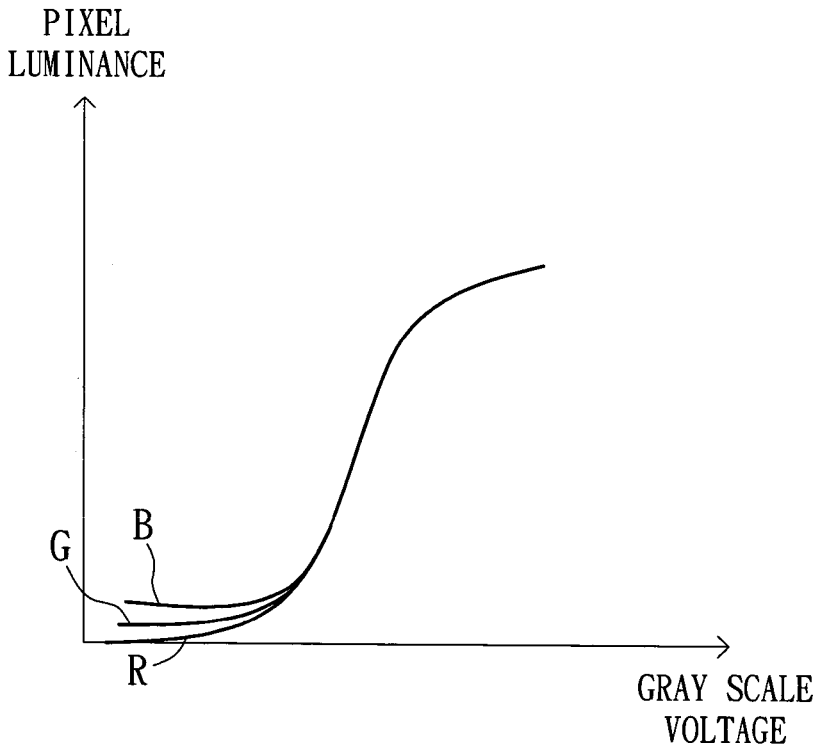
FIG. 4B(PRIOR ART)
Figure 4C:
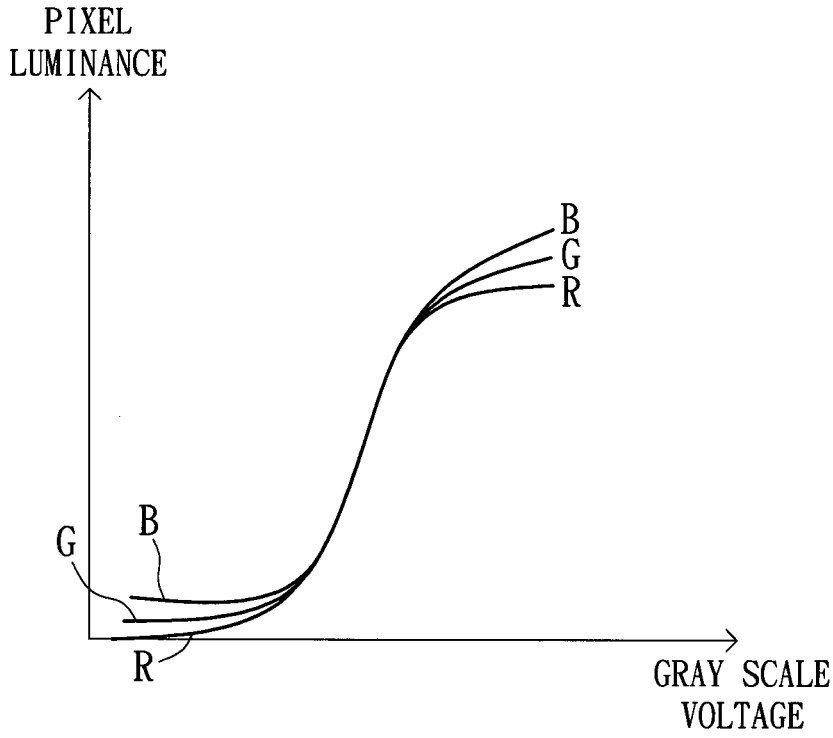
FIG. 4C(PRIOR ART)
Figure 4D:
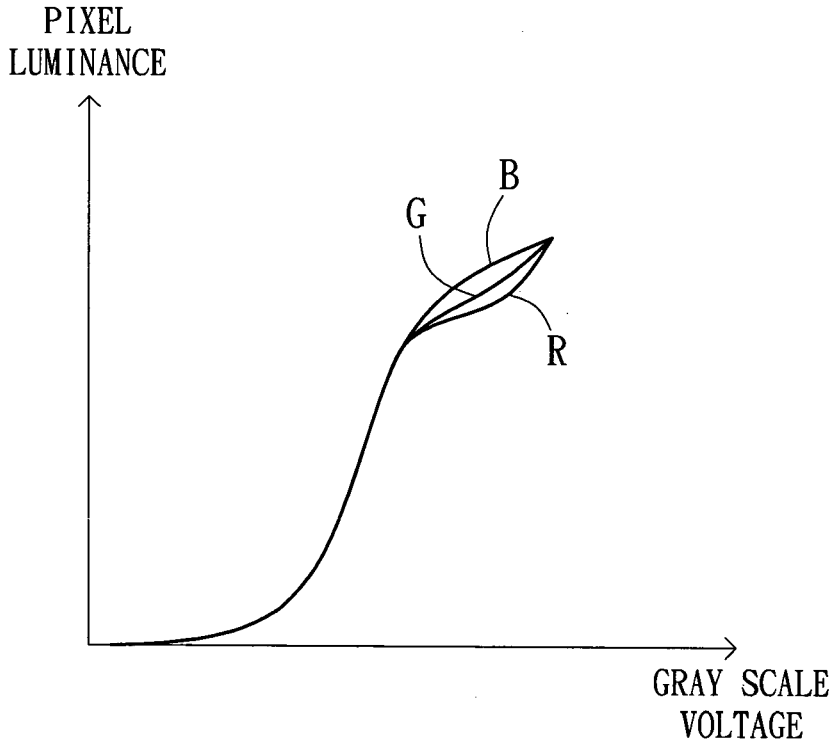
FIG. 4D (PRIOR ART)
Figure 4E:
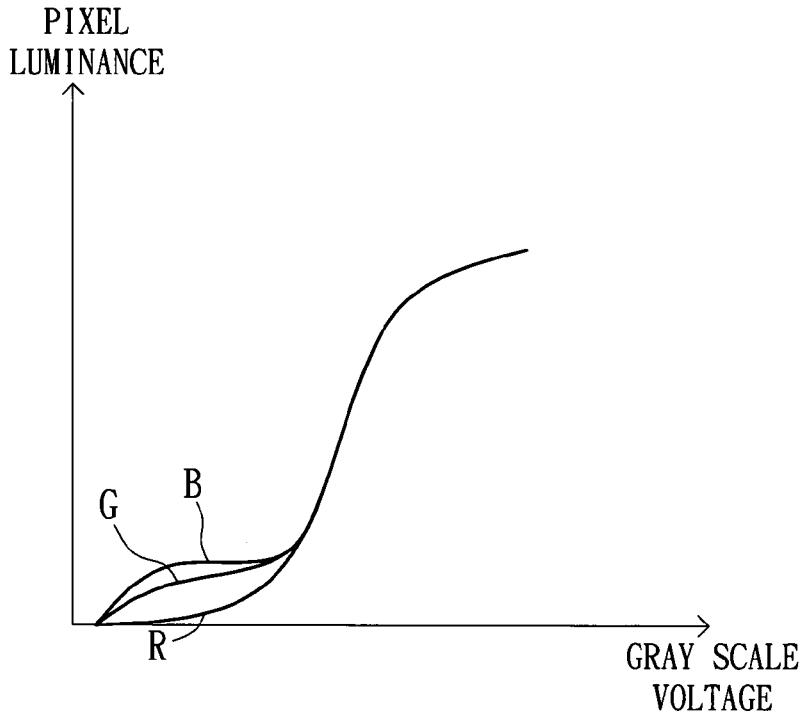
FIG. 4E(PRIOR ART)
Figure 4F:
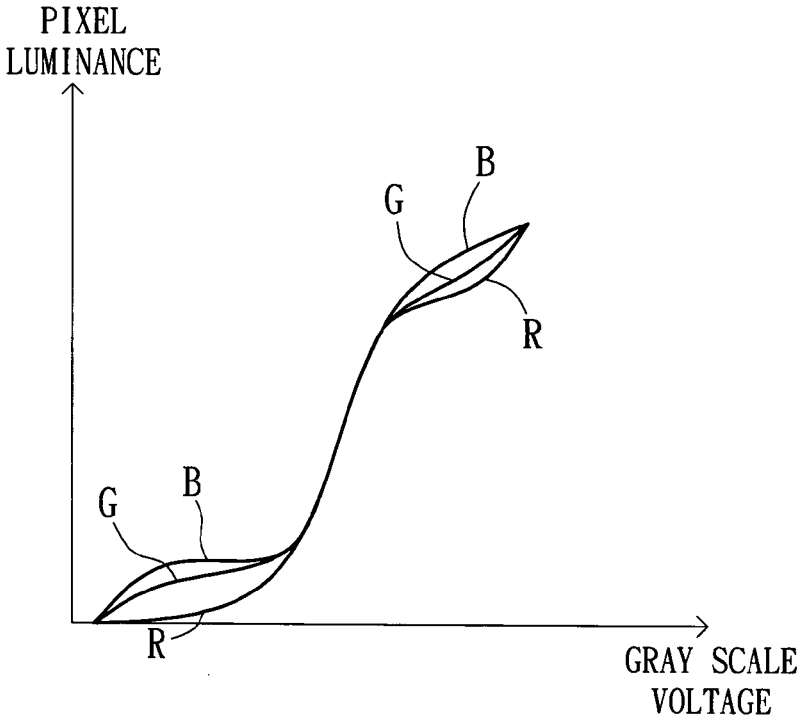
FIG. 4F(PRIOR ART)
Figure 4G:
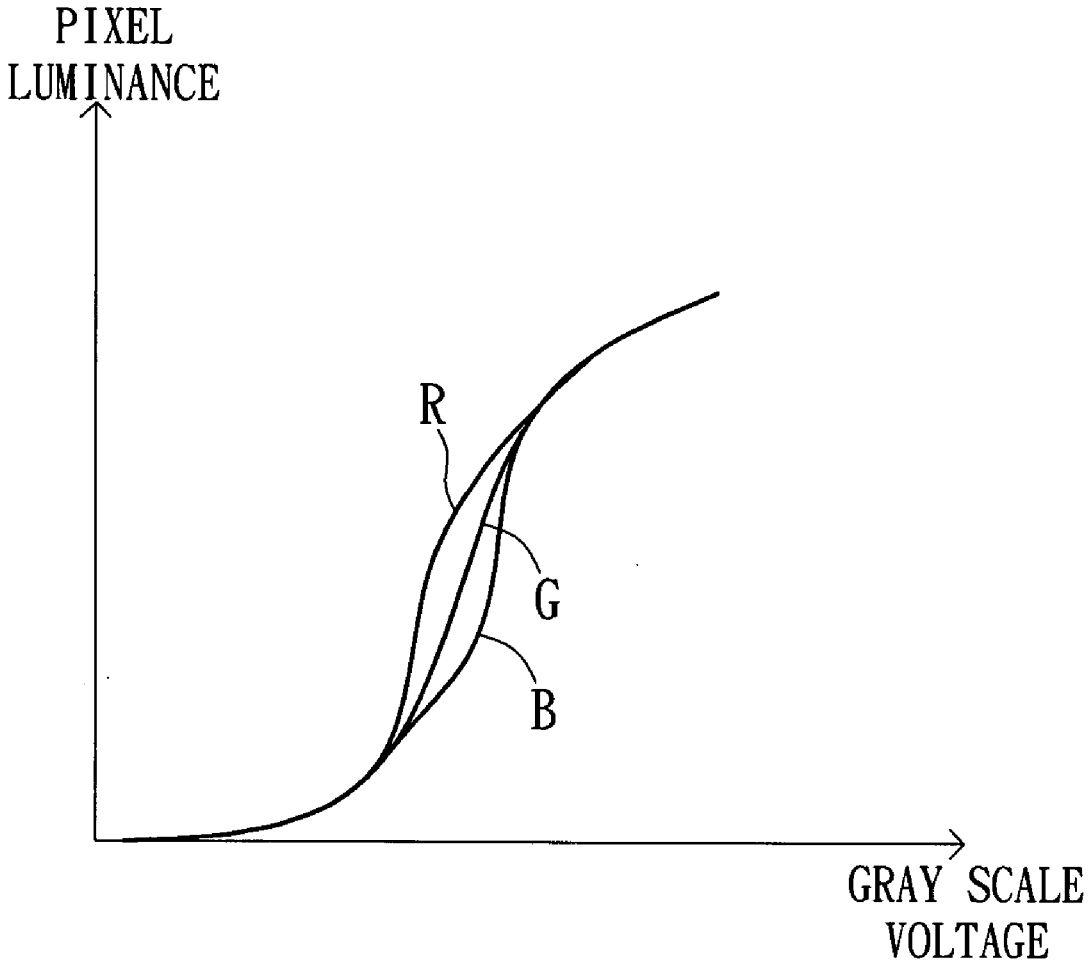
FIG. 4G(PRIOR ART)
Figure 5:
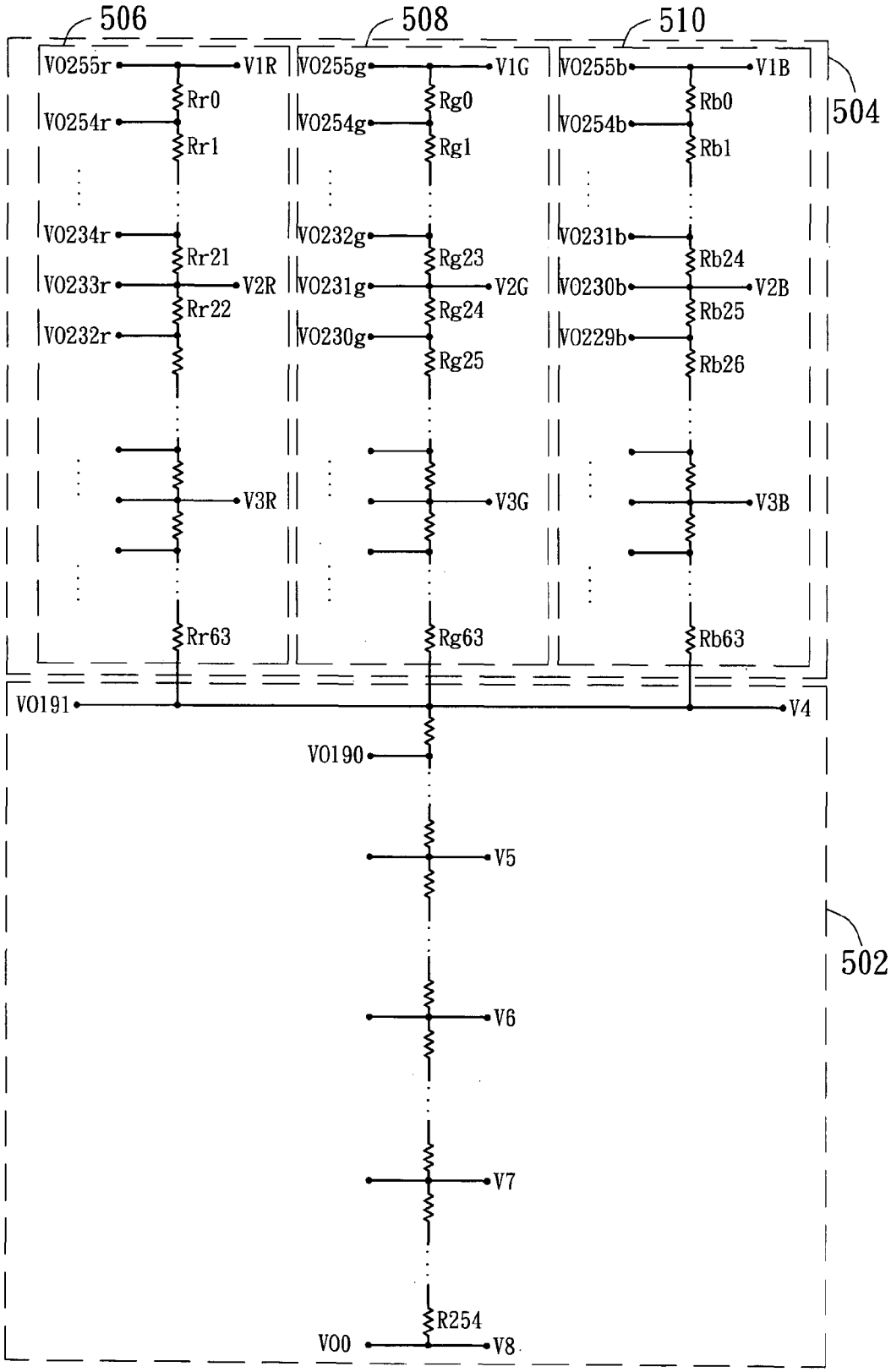
FIG. 5 is a circuit diagram for the first gray-scale voltage generating circuit according to the preferred embodiment of the present invention.

Please refer to FIG. 5, a circuit diagram for a first gray-scale voltage generating circuit according to the preferred embodiment of the present invention. The gray-scale voltage generating circuit 500 is utilized to generate 256 gray-scale voltages according to inputted reference voltages, wherein each gray-scale voltage corresponds to a pixel signal. It is noteworthy that a complete gray-scale voltage generating circuit includes two gray-scale voltage generating circuits 500, as shown in FIG. 5, one for generating 256 positive polarity gray-scale voltages and the other for generating 256 negative gray-scale voltages. The theory and operation of the two gray-scale voltage generating circuits are very similar. Basing on the theory and operation of one of the two gray-scale voltage generating circuits, anyone who is skilled in the technology disclosed in the present invention can understand the theory and operation of the other gray-scale voltage generating circuit by analogy. In this regard, the other gray-scale voltage generating circuit will not be explained for the sake of brevity.

The gray-scale voltage generating circuit 500 includes two parts: a common gray-scale voltage generating circuit 502 and an individual gray-scale voltage generating circuit 504, wherein the individual gray-scale voltage generating circuit 504 includes a red gray-scale voltage generating circuit 506, a green gray-scale voltage generating circuit 508, and a blue gray-scale voltage generating circuit 510. The red gray-scale voltage generating circuit 506, the green gray-scale voltage generating circuit 508, and the blue gray-scale voltage generating circuit 510 are coupled to the common gray-scale voltage generating circuit at the same end line as shown in FIG. 5.

Figure 6A:
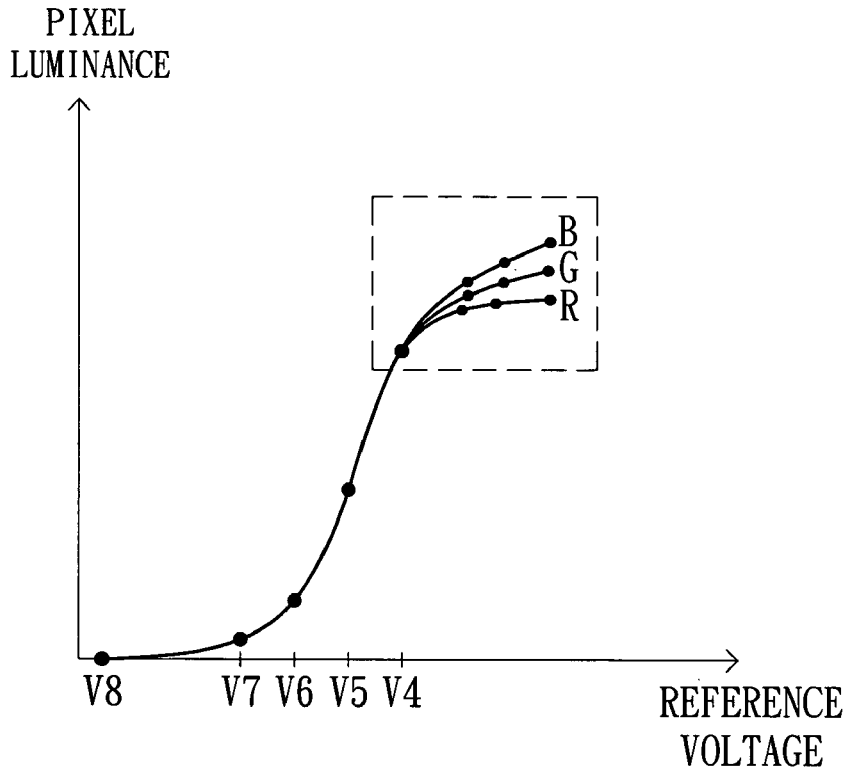
FIGS. 6A to 6B are diagrams of the gamma curve relationship applicable to the gray-scale voltage generating circuit shown in FIG. 5.

Please refer to FIG. 6A, a diagram of the gamma curve relationship applicable to the gray-scale voltage generating circuit shown in FIG. 5. In FIG. 6A, the three gamma curves labeled R, G, B represent the relationship between the gray-scale voltages applied to pixels of different colors and the luminance of the pixels which display the red, green, and blue colors individually. It can be seen in FIG. 6A that when pixel voltage is relatively low, pixel luminance has only little difference and can thus be neglected. However, when pixel voltage turns higher, luminance difference becomes larger accordingly.

In the present embodiment, the common gray-scale voltage generating circuit 502 is a series circuit composed of 191 serial resistors with 5 input nodes for the input of five common reference voltages V4, V5, V6, V7, and V8 respectively, and with 192 output nodes for outputting common gray-scale voltages VO0 to VO191 respectively. According to voltage dividing rule, the value of the gray-scale voltage outputted from each output node can be controlled by appropriately setting the resistance value of each serial resistor. The values of reference voltages V4 to V8 are indicated in FIG. 6A. It can be seen that the gamma curves of different pixel color shows very tiny difference in the part corresponding to reference voltages V4 to V8. gray-scale voltages VO0 to VO191 generated by the common gray-scale voltage generating circuit 502 according to reference voltages V4 to V8 correspond to the 192 pixel signals labeled from 0 to 191 respectively. In addition, the relationship between pixel signals 0 to 191 and the corresponding gray-scale voltages VOO to V0191 does not vary with the different colors that the pixels display.

Figure 6B:
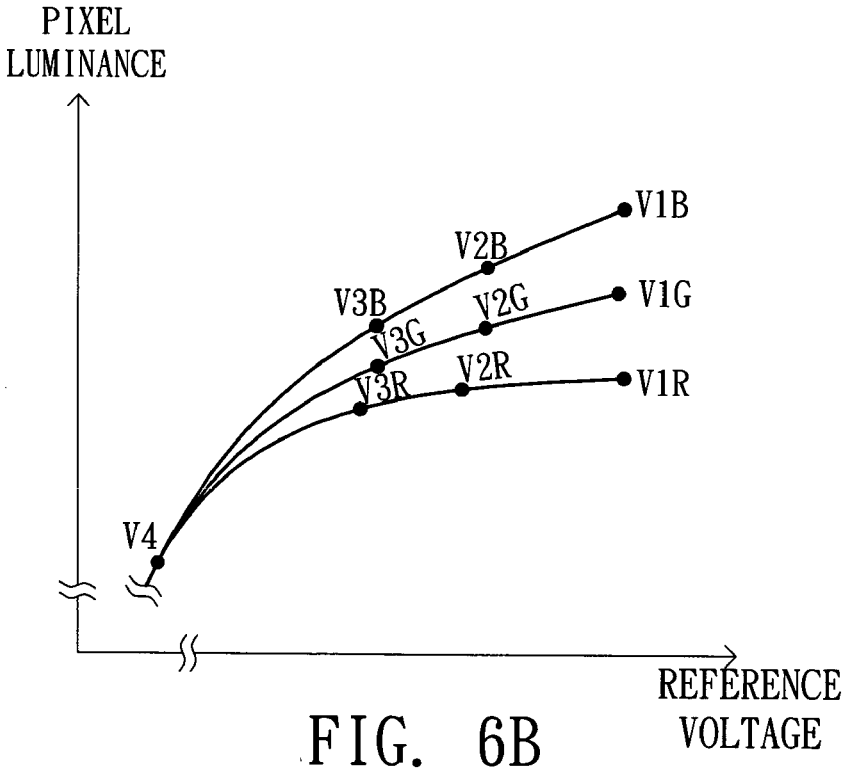

Please refer to FIGS. 6A and 6B again. In FIG. 6A, when pixel voltage turns higher, luminance difference among pixels displaying different colors turns larger accordingly. FIG. 6B is the enlargement for the part indicated by a dashed rectangle in FIG. 6A. In FIG. 6B, differences among gamma curves for different colors are significant and are intensified when gray-scale voltage turns higher. In the present invention, individual gray-scale voltage generating circuits 504 generate gray-scale voltages according to respective gamma curves (for the red, green, and blue colors respectively) for the part where differences among them are large (as is shown in FIG. 6B). In this way, a linear relationship between pixel signal is achieved, regardless of the color that the pixel displays.

In the present embodiment, the individual gray-scale voltage generating circuits 504, corresponding to the three colors displayed in the pixels of an ordinary LCD panel, includes a red gray-scale voltage generating circuit 506, a green gray-scale voltage generating circuit 508 and a blue gray-scale voltage generating circuit 510. Take the red gray-scale voltage generating circuit 506 for example. The red gray-scale voltage generating circuit 506 is a series of resistors composed of 64 serial resistors, wherein each series of resistors has 3 input nodes for the input of common reference voltages V1R, V2R and V3R respectively, and 64 output nodes for the output of red gray-scale voltages VO192*r* to VO255*r* respectively. The value of each of the 64 red gray-scale voltages VO192r to VO255r outputted from output nodes is determined according to gamma curve R shown in FIG. 6B. The values of the above 64 gray-scale voltages can be determined in two ways. The first way is to set an appropriate resistance value of each of the 64 resistors Rr0 to Rr63; the second way is to set an appropriate voltage value of each of the three reference voltages V1R to V3R applied to the series of resistors and determine an appropriate location for each input node in the series of resistors. According to the voltage dividing rule, the value of each gray-scale voltage outputted from an output node can thus be determined. Referring to FIG. 5 again, since reference voltage V1R must be applied at the input node situated at the top end of the red gray-scale voltage generating circuit 506, the value of the gray-scale voltage to be generated can only be controlled via the control of V1R value. For reference voltages V2R and V3R, the value of each gray-scale voltage outputted from an output node can be determined by controlling the values of reference voltages V2R and V3R as well as the locations of the corresponding input nodes disposed in the gray-scale voltage generating circuit 506. A linear relationship between the pixel signals numbered 192 to 255 and the pixel luminance according to gamma curve R can thus be obtained by controlling the values of gray-scale voltages VO192*r* to VO255*r* outputted from the red gray-scale voltage generating circuit 506.

The operation and theory of the green gray-scale voltage generating circuit 508 and the blue gray-scale voltage generating circuit 510 are similar to those of the red gray-scale voltage generating circuit disclosed above and will not be repeated here. It is noteworthy that the green gray-scale voltage generating circuit 508 and the blue gray-scale voltage generating circuit 510 determine the values of the outputted gray-scale voltages according to gamma curve G and gamma curve B respectively as shown in FIGS. 6A and 6B. Thus, for the green gray-scale voltage generating circuit 508 and the blue gray-scale voltage generating circuit 510, the resistance value of each resistor, the value of each reference voltage, and the location in a series of resistors for the corresponding input node of a gray-scale voltage generating circuit will not be exactly identical to those of the red gray-scale voltage generating circuit 506. As a result, the relationship between the pixel signals 192 to 255, corresponding to green gray-scale voltages VO192*g* to VO255*g* outputted from the green gray-scale voltage generating circuit 508, and pixel luminance levels will be linear according to gamma curve G. In addition, the relationship between the pixel signals 192 to 255, corresponding to blue gray-scale voltages VO192*b* to VO255*b* outputted from the blue gray-scale voltage generating circuit 510, and pixel luminance will be linear according to gamma curve B.

It is noteworthy that although both the common gray-scale voltage generating circuit 502 and the individual gray-scale voltage generating circuit 504 are series of resistors in the present embodiment, this is not a restriction to the present invention. Any device, which outputs corresponding gray-scale voltages of pixel signals via inputted reference voltages according to respective gamma curve, is in accordance with the spirit of the present invention.

Figure 7:
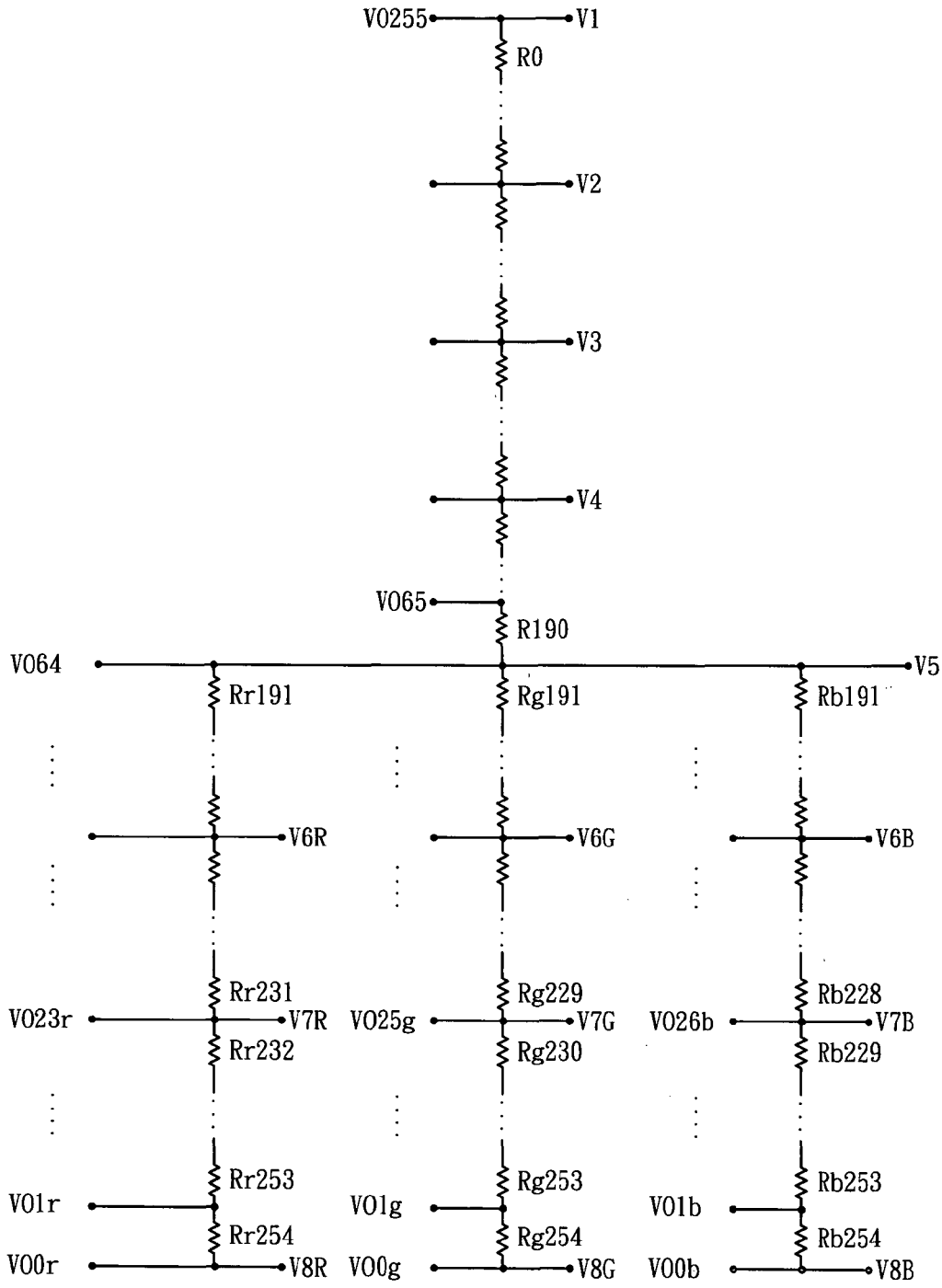
FIG. 7 is a circuit diagram for the second gray-scale voltage generating circuit according to the preferred embodiment of the present invention.
Figure 8:
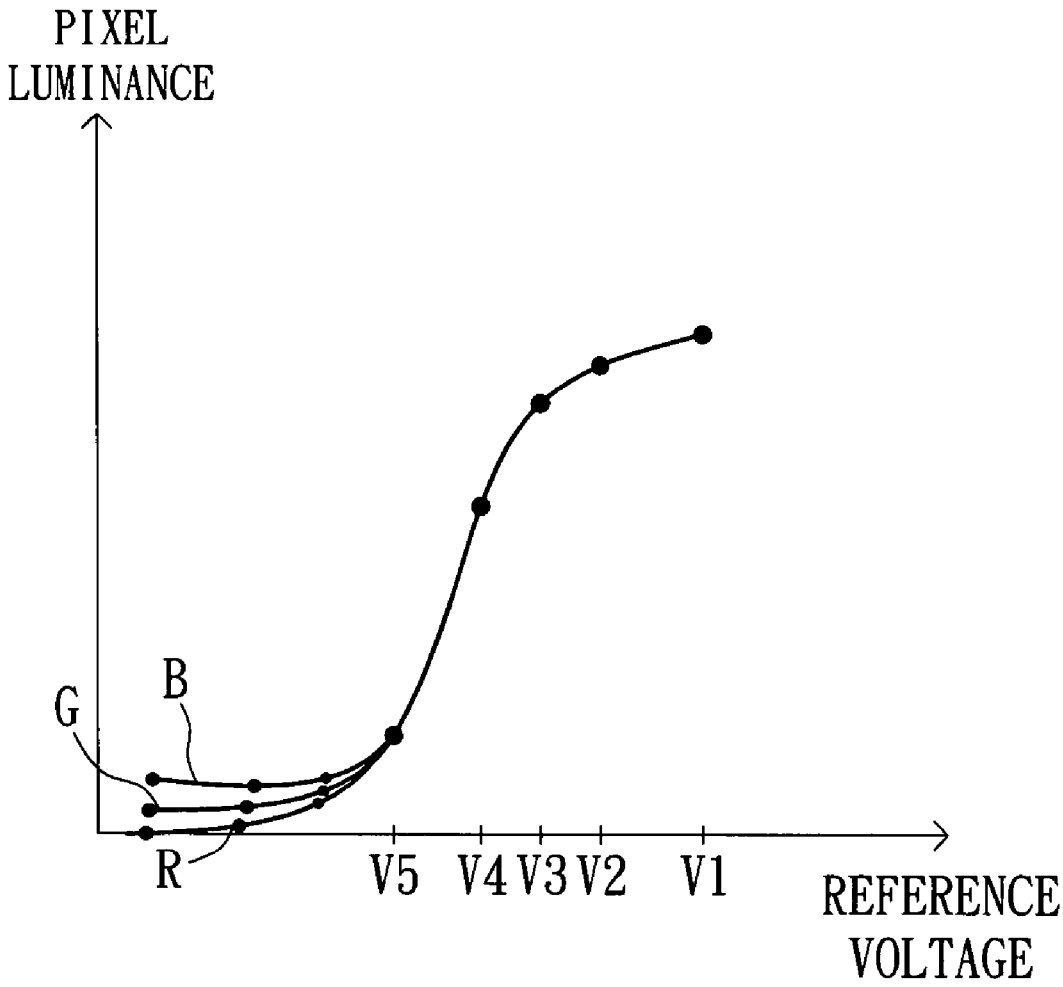
FIG. 8 is a diagram of the gamma curve relationship applicable to the gray-scale voltage generating circuit shown in FIG. 7.

As is disclosed above, the gamma curve relationship between the gray-scale voltage applied to pixels and the luminance of the pixels varies with the molecular conformation of liquid crystal of the pixels. The gray-scale voltage generating circuit provided in the present invention can be modified to become applicable to varied gamma curves. Referring to FIG. 7, a circuit diagram for a second gray-scale voltage generating circuit is illustrated according to the preferred embodiment of the present invention, with the common gray-scale voltage generating circuit which outputs gray-scale voltages VO64 to VO255 corresponding to pixel signals 64 to 255 respectively. According to gamma curves R, G, and B shown in FIG. 8, the red gray-scale voltage generating circuit, the green gray-scale voltage generating circuit and the blue gray-scale voltage generating circuit generate red gray-scale voltages VO0*r* to VO63*r*, green gray-scale voltages VO0*g* to VO63*g*, and blue gray-scale voltages VO0*b* to VO63 respectively. The three groups of gray-scale voltages all correspond to pixel signal 0 to pixel signal 63. The gray-scale voltage generating circuit shown in FIG. 7 is applicable to the gamma curve relationship shown in FIG. 8.

Figure 9:
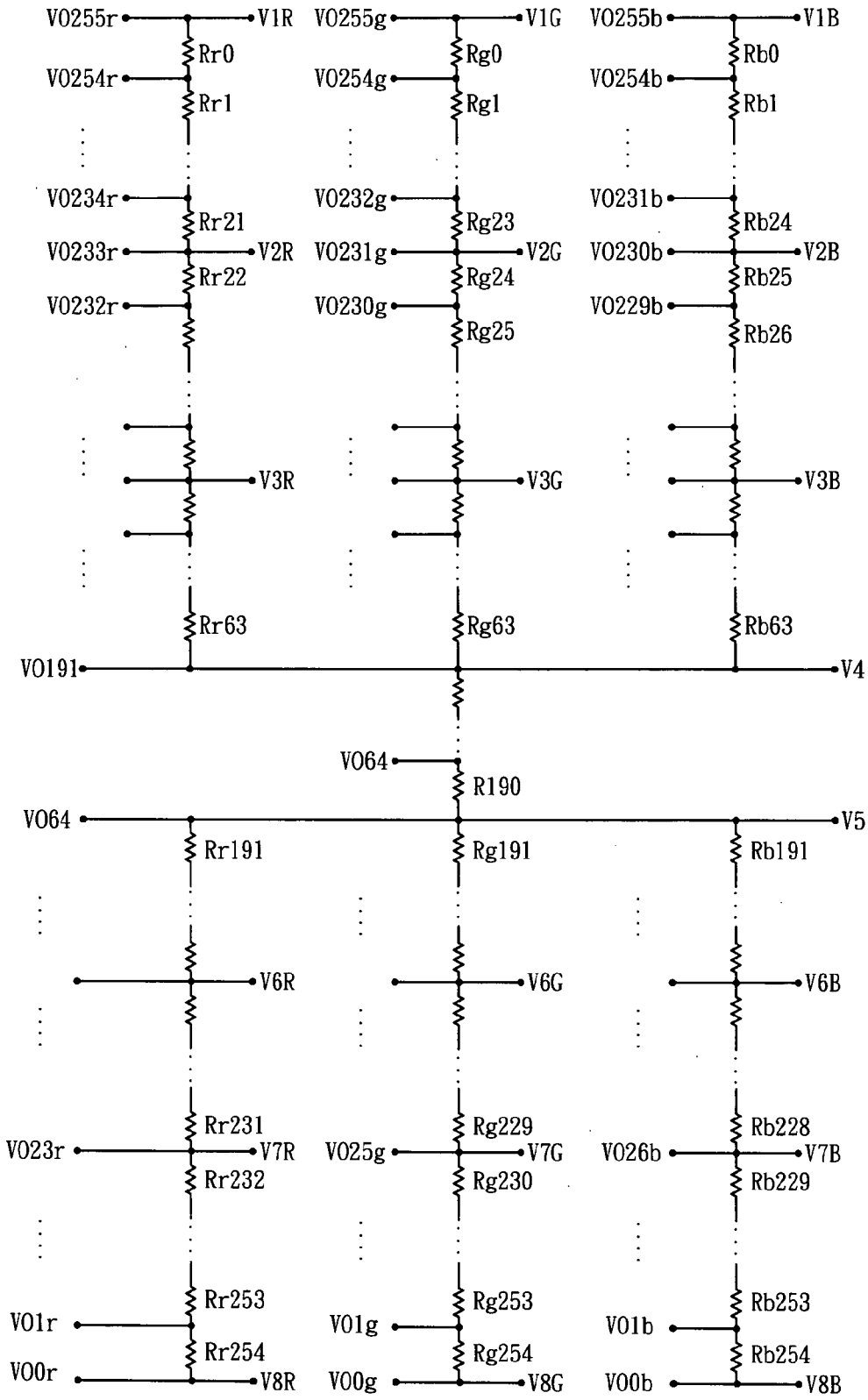
FIG. 9 is a circuit diagram for the third gray-scale voltage generating circuit according to the preferred embodiment of the present invention.
Figure 10:
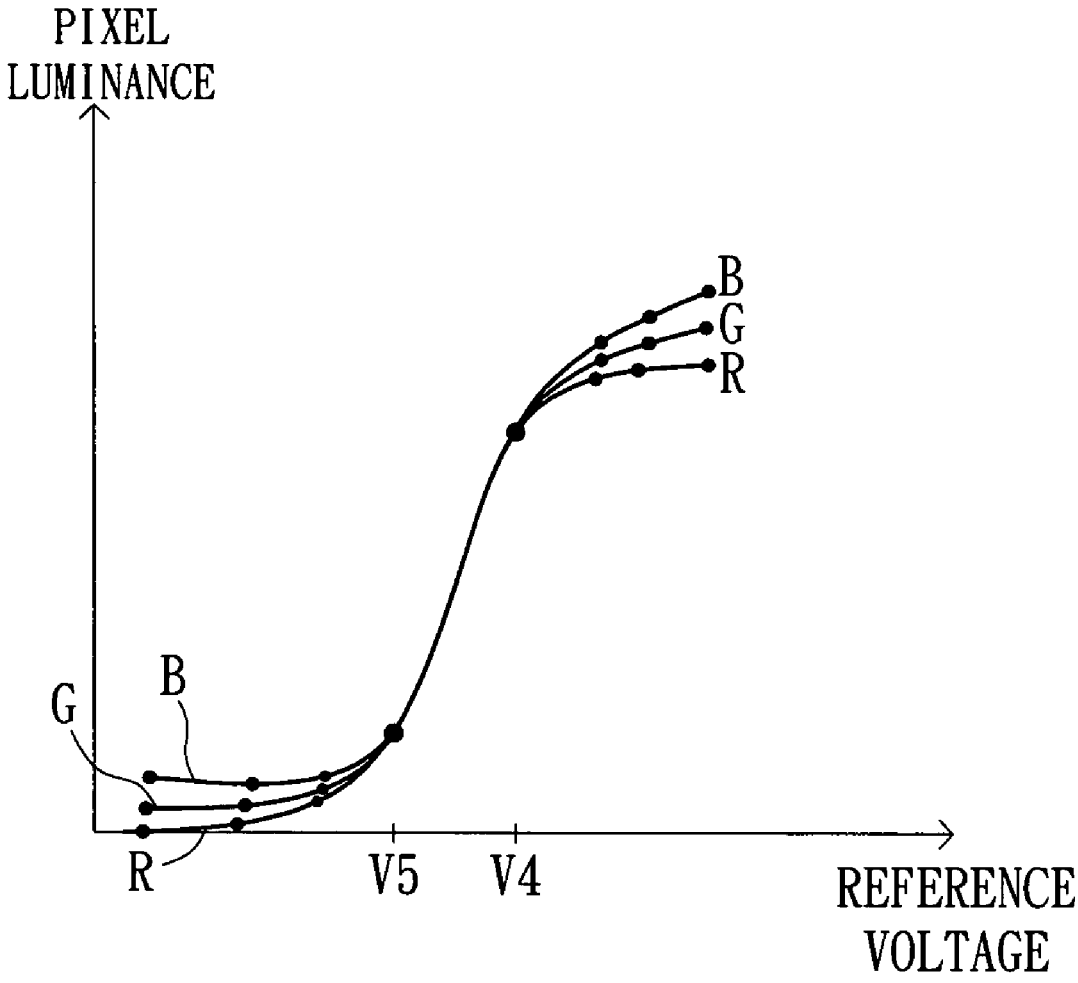
FIG. 10 is a diagram of the gamma curve relationship applicable to the gray-scale voltage generating circuit shown in FIG. 9.
Figure 11:
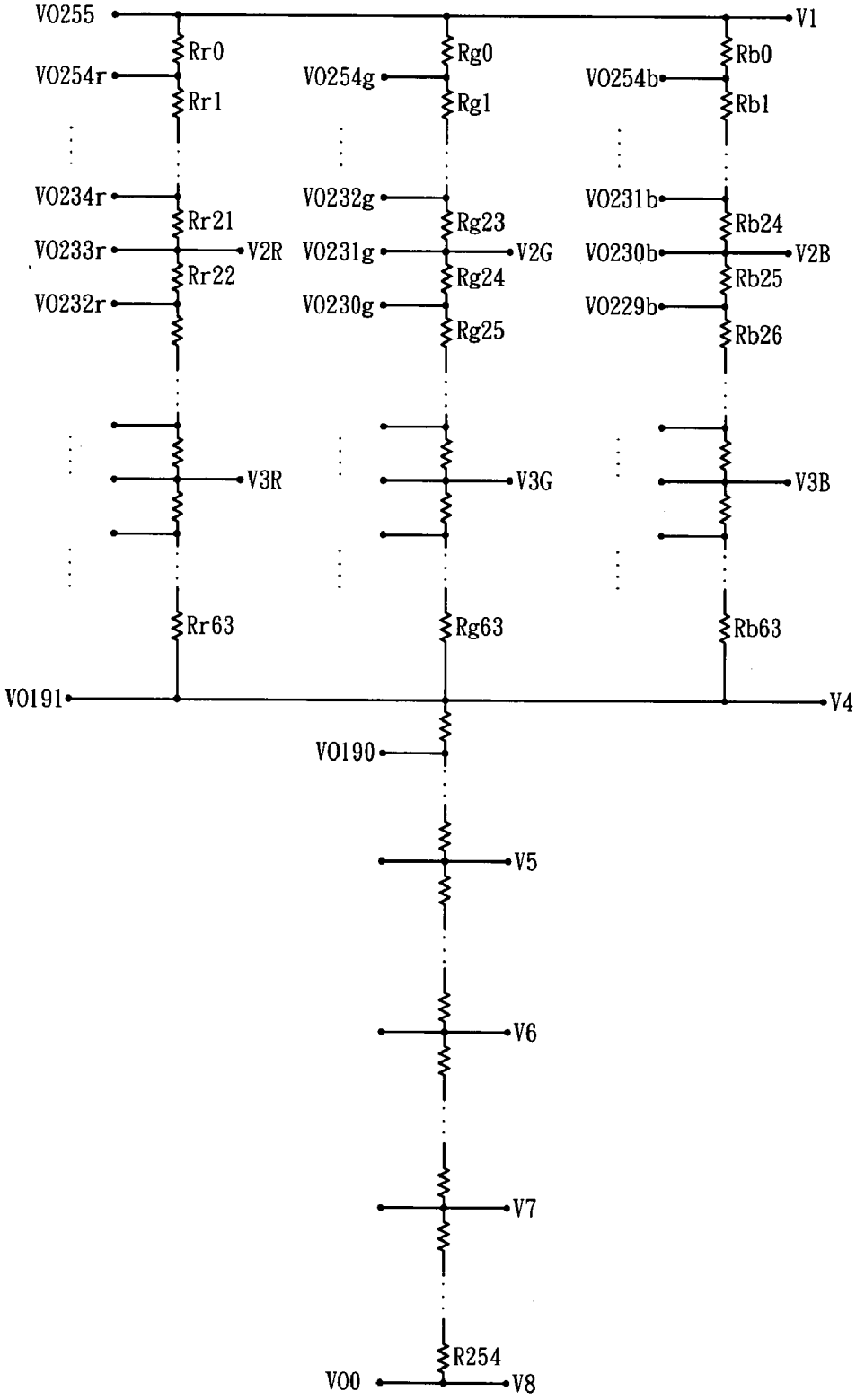
FIG. 11 is a circuit diagram for the fourth gray-scale voltage generating circuit according to the preferred embodiment of the present invention.
Figure 12:
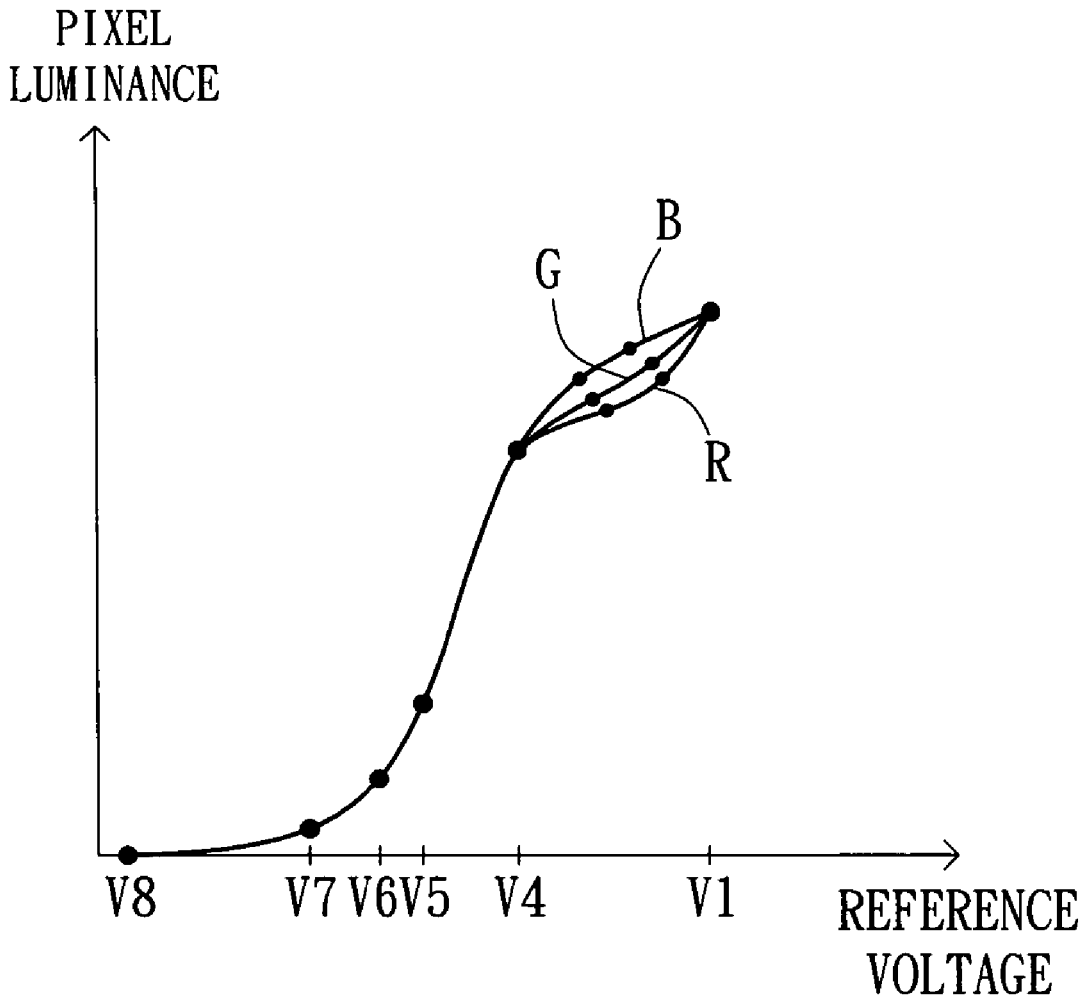
FIG. 12 is a diagram of the gamma curve relationship applicable to the gray-scale voltage generating circuit shown in FIG. 11.
Figure 13:
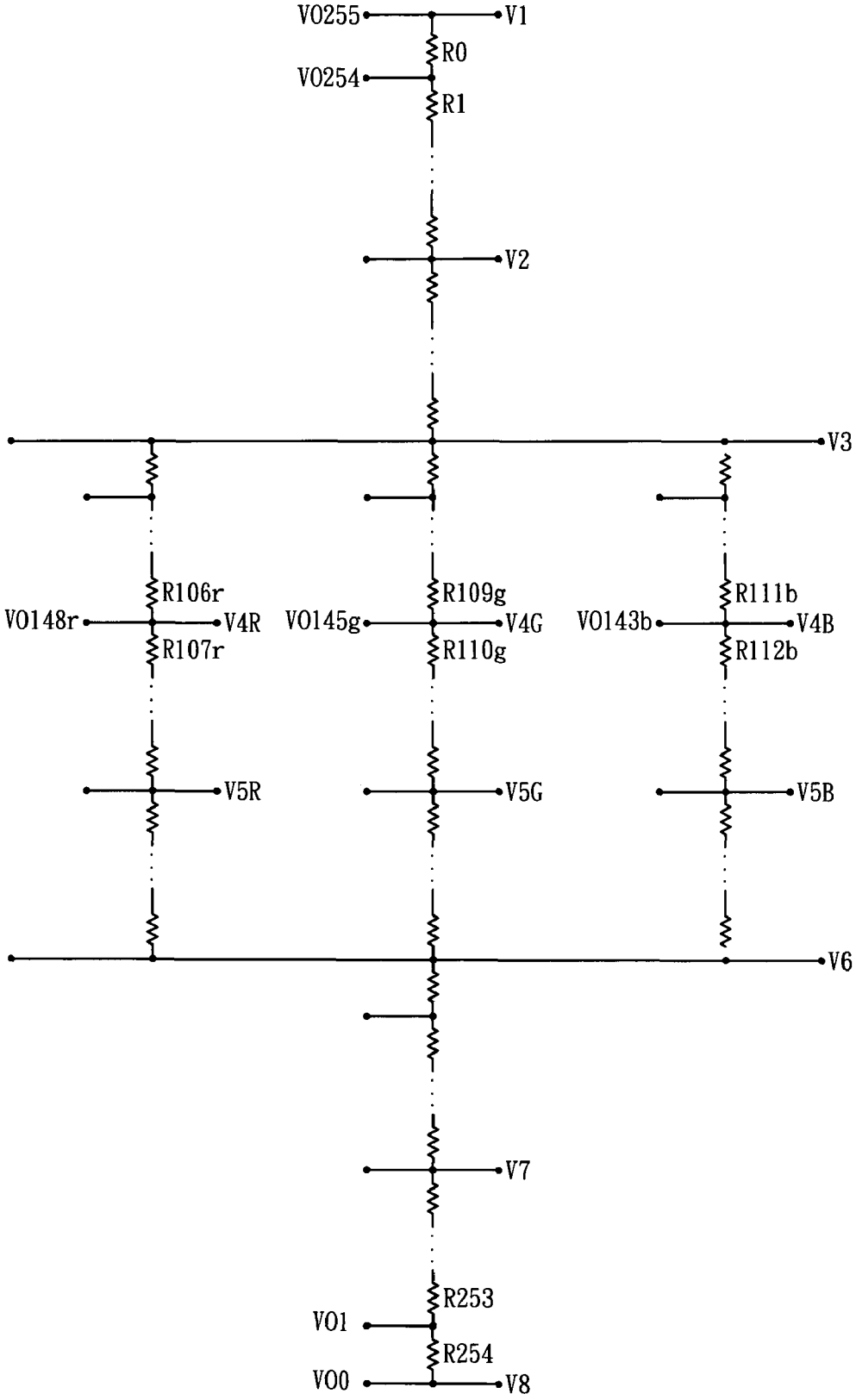
FIG. 13 is a circuit diagram for the fifth gray-scale voltage generating circuit according to the preferred embodiment of the present invention.
Figure 14:
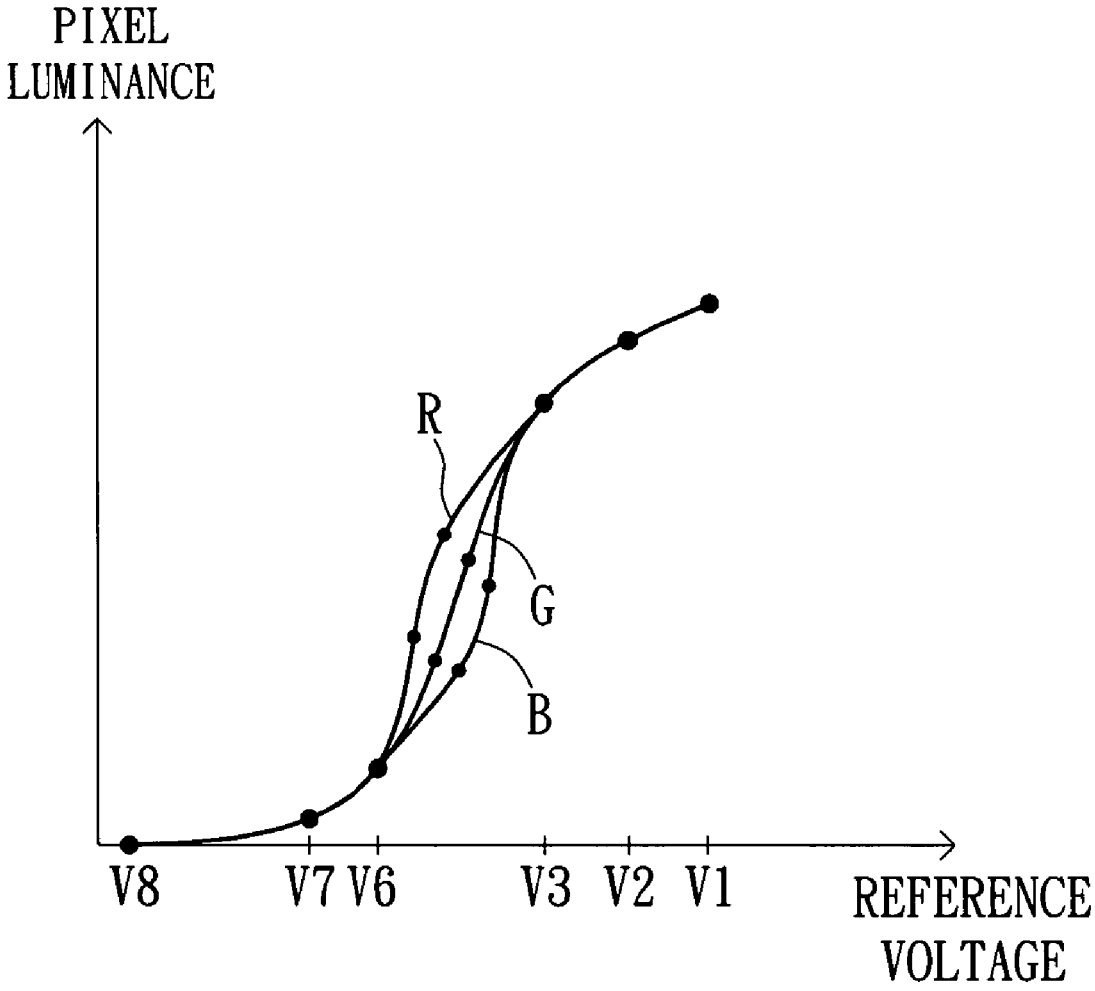
FIG. 14 is a diagram of the gamma curve relationship applicable to the gray-scale voltage generating circuit shown in FIG. 13.

The individual gray-scale voltage generating circuits as shown in FIG. 9 have two parts. Take the red gray-scale voltage generating circuit for example. The red gray-scale voltage generating circuit includes two series of resistors: one generates red gray-scale voltages VO255*r* to VO191 *r* according to reference voltages V1R to V3R, while the other generates red gray-scale voltages VO63*r* to VO1 *r* according to reference voltages V6R to V8R. The gray-scale voltage generating circuit as shown in FIG. 9 is applicable to the gamma curve relationship as shown in FIG. 10. Similarly, the gray-scale voltage generating circuit as shown in FIG. 11 is applicable to the gamma curve relationship as shown in FIG. 12, while the gray-scale voltage generating circuit as shown in FIG. 13 is applicable to the gamma curve relationship as shown in FIG. 14. It is noteworthy that although the gray-scale voltage generating circuits shown in FIGS. 5, 7, 9, 11, and 13 are different and are applicable to gamma curves of varied types, they still share one common characteristic. That is, when differences among gamma curves for different colors are large, the relationship between gray-scale voltage values of the gray-scale voltage generating circuit and corresponding pixel signals thereof is determined and outputted according to respective gamma curve. In this way, no matter what color the pixel displays, a linear relationship between pixel signal and pixel luminance can be obtained without deviating from the spirit of the present invention.

The gray-scale voltages outputted from the gray-scale voltage generating circuit will be inputted to a gamma correction circuit. The gray-scale voltages include common gray-scale voltages and individual gray-scale voltages, wherein the individual gray-scale voltages include red gray-scale voltages VOr, green gray-scale voltages VOg, and blue gray-scale voltages VOb. After receiving a pixel signal, the gamma correction circuit executes gamma correction according to the common gray-scale voltages and the individual gray-scale voltages corresponding to the pixel signal to determine a corresponding pixel voltage of the pixel signal, and to output the pixel voltage. If the pixel signal is used to control the luminance of a pixel used to display the red color, the relationship between the pixel signal and the pixel voltage will be determined according to values of the common gray-scale voltages and the red gray-scale voltages. By the same analogy, if the pixel signal is used to control the luminance of a pixel used to display the green (the blue) color, the relationship between the pixel signal and the pixel voltage will be determined according to the values of the common gray-scale voltages and the green (the blue) gray-scale voltages.

A gamma correction device is disclosed in above examples of embodiment. When gamma correction is performed, the relationship between the pixel signals for displaying different colors and the values of corresponding gray-scale voltages are identical in some pixel signal value region but different in others. In this way, the gamma characteristics for the three colors, red, green and blue, can be optimized and the display quality of the LCD panel be improved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A gamma correction apparatus for outputting a corresponding pixel voltage according to a pixel signal for a liquid crystal display (LCD), wherein the LCD has a plurality of pixels used to display a plurality of colors, the gamma correction apparatus comprising:

a gray-scale voltage generating circuit, which comprises:

a common gray-scale voltage generating circuit for generating a plurality of common gray-scale voltages; and a plurality of individual gray-scale voltage generating circuits, coupled to the common gray-scale voltage generating circuit, wherein each of the individual gray-scale voltage generating circuits generates a plurality of individual gray-scale voltages corresponding to one of the colors, and the values of the individual gray-scale voltages generated by each individual gray-scale voltage generating circuit are determined according to what color the individual gray-scale voltage generating circuit corresponds to; and a gamma correction circuit, coupled to the common gray-scale voltage generating circuit and the individual gray-scale voltage generating circuits, wherein according to a corresponding color of the pixel signal, the gamma correction circuit generates the corresponding pixel voltage based on the common gray-scale voltages and the corresponding individual gray-scale voltages of the corresponding color.

2. A gamma correction apparatus according to claim 1, wherein the common gray-scale voltage generating circuit comprises a series of resistors with a plurality of connecting nodes wherein each of the common gray-scale voltages is generated through a corresponding one of the connecting nodes.

3. A gamma correction apparatus according to claim 1, wherein each of the individual gray-scale voltage generating circuits has a plurality of input nodes with each of the input nodes being coupled to a corresponding input voltage source which supplies a corresponding reference voltage to the individual gray-scale voltage generating circuit coupled thereto.

4. A gamma correction apparatus according to claim 3, wherein the value of the reference voltage supplied is determined according to the color corresponding to the individual gray-scale voltage generating circuit coupled to the corresponding input voltage source.

5. A gamma correction apparatus according to claim 3, wherein the input nodes of each individual gray-scale voltage generating circuit are disposed therein according to the color corresponding to the individual gray-scale voltage generating circuit.

6. A gamma correction apparatus according to claim 3, wherein each individual gray-scale voltage generating circuit has a plurality of output nodes for generating the individual gray-scale voltages according to the reference voltages.

7. A gamma correction apparatus according to claim 6, wherein each individual gray-scale voltage generating circuit is a voltage divider with a series of resistors with a plurality of connecting nodes.

8. A gamma correction apparatus according to claim 1, wherein the colors include red, green and blue.

9. A gamma correction apparatus according to claim 8, wherein the individual gray-scale voltage generating circuits are:

a red gray-scale voltage generating circuit for generating a plurality of red gray-scale voltages;

a green gray-scale voltage generating circuit for generating a plurality of green gray-scale voltages; and a blue gray-scale voltage generating circuits for generating a plurality of blue gray-scale voltages;

wherein the gamma correction circuit outputs the pixel voltage corresponding to the pixel signal according to:

the common gray-scale voltages and the red gray-scale voltages when the pixel signal is used to display the color red;

the common gray-scale voltages and the green gray-scale voltages when the pixel signal is used to display the color green; and the common gray-scale voltages and the blue gray-scale voltages when the pixel signal is used to display the color blue.

10. A gamma correction apparatus according to claim 1, wherein the corresponding pixel voltage is substantially equal to one of the common gray-scale voltages and the corresponding individual gray-scale voltages.

11. A gamma correction apparatus according to claim 1, wherein the common gray-scale voltage generating circuit comprises a series of resistors with a plurality of nodes, each individual gray-scale voltage generating circuit comprises a series of resistors, one end of the series of resistors of the respective individual gray-scale voltage generating circuits is are connected together, and the connected ends of the series of resistors of the individual gray-scale voltage generating circuits are further connected to one node of the series of resistors of the common gray-scale voltage generating circuit.

12. A gamma correction apparatus for outputting a corresponding pixel voltage according to a pixel signal for a liquid crystal display (LCD), wherein the LCD has a plurality of pixels used to display the colors red, green, and blue, the gamma correction apparatus comprising:

a gray-scale voltage generating circuit, comprising:

a common gray-scale voltage generating circuit for generating a plurality of common gray-scale voltages;

a red individual gray-scale voltage generating circuit coupled to the common gray-scale voltage generating circuit for generating a plurality of red gray-scale voltages;

a green individual gray-scale voltage generating circuit coupled to the common gray-scale voltage generating circuit for generating a plurality of green gray-scale voltages; and a blue individual gray-scale voltage generating circuit coupled to the common gray-scale voltage generating circuit for generating a plurality of blue gray-scale voltages; and a gamma correction circuit coupled to the common gray-scale voltage generating circuit and the red, green, and blue individual gray-scale voltage generating circuits;

wherein the gamma correction circuit outputs the pixel voltage corresponding to the pixel signal based on:

the common gray-scale voltages and the red gray-scale voltages when the pixel signal is used to display the color red;

the common gray-scale voltages and the green gray-scale voltages when the pixel signal is used to display the color green; and the common gray-scale voltages and the blue gray-scale voltages when the pixel signal is used to display the color blue.

13. A gamma correction apparatus according to claim 12, wherein:

the red gray-scale voltage generating circuit has a plurality of input nodes with each of the input nodes being coupled to a corresponding input voltage source which supplies a corresponding reference voltage to the red gray-scale voltage generating circuit coupled thereto;

the green gray-scale voltage generating circuit has a plurality of input nodes with each of the input nodes being coupled to a corresponding input voltage source which supplies a corresponding reference voltage to the green gray-scale voltage generating circuit coupled thereto; and the blue gray-scale voltage generating circuit has a plurality of input nodes with each of the input nodes being coupled to a corresponding input voltage source which supplies a corresponding reference voltage to the blue gray-scale voltage generating circuit coupled thereto.

14. A gamma correction apparatus according to claim 13, wherein the red gray-scale voltage generating circuit includes a plurality of output nodes for generating the red gray-scale voltages according to the reference voltages thereof; the green gray-scale voltage generating circuit includes a plurality of output nodes for generating the green gray-scale voltages according to the reference voltages thereof; and the blue gray-scale voltage generating circuit includes a plurality of output nodes for generating the blue gray-scale voltages according to the reference voltages thereof.

15. A gamma correction apparatus according to claim 14, wherein the red gray-scale voltage generating circuit, the green gray-scale voltage generating circuit, and the blue gray-scale voltage generating circuit each include a series of resistors with a plurality of connecting nodes.

16. A gamma correction apparatus according to claim 15, wherein at least one of the connecting nodes is the input node, at least one of the connecting nodes is the output node, and at least one output node is the input node.

17. A gamma correction apparatus according to claim 12, wherein the pixel voltage is substantially equal to one of the common gray-scale voltages and the red individual gray-scale voltages when the pixel signal is used to display the color red, the pixel voltage is substantially equal to one of the common gray-scale voltages and the green individual gray-scale voltages when the pixel signal is used to display the color green; and the pixel voltage is substantially equal to one of the common gray-scale voltages and the blue individual gray-scale voltages when the pixel signal is used to display the color blue.

18. A gamma correction apparatus according to claim 12, wherein the common gray-scale voltage generating circuit comprises a series of resistors with a plurality of nodes, each of the red, green, and blue gray-scale voltage generating circuits comprises a series of resistors, one end of the respective series of resistors of the respective red, green, and blue gray-scale voltage generating circuits are connected together and the connected ends of the series of resistors of the respective red, green, and blue gray-scale voltage generating circuits are further connected to one node of the series of resistors of the common gray-scale voltage generating circuit.

19. A liquid crystal display (LCD), comprising:

a plurality of pixels for displaying a plurality of colors; and a gamma correction apparatus, which outputs a corresponding pixel voltage according to a pixel signal, comprising:

a gray-scale voltage generating circuit, comprising:

a common gray-scale voltage generating circuit for generating a plurality of common gray-scale voltages; and a plurality of individual gray-scale voltage generating circuits, coupled to the common gray-scale voltage generating circuit, wherein each of the individual gray-scale voltage generating circuits generates a plurality of individual gray-scale voltages, each individual gray-scale voltage generating circuit corresponds to one of the colors, and the values of the individual gray-scale voltages generating from each individual gray-scale voltage generating circuit is determined according to what color the individual gray-scale voltage generating circuit corresponds to; and a gamma correction circuit, coupled to the common gray-scale voltage generating circuit and the individual gray-scale voltage generating circuits, wherein according to a color corresponding to the pixel signal, the gamma correction circuit generates the corresponding pixel voltage based on the common gray-scale voltages and the corresponding individual gray-scale voltages of the corresponding color.

20. An LCD according to claim 13, wherein the common gray-scale voltage generating circuit comprises a series of resistors with a plurality of connecting nodes wherein each of the common gray-scale voltages is generated through one of the connecting nodes.

21. An LCD according to claim 13, wherein each of the individual gray-scale voltage generating circuits has a plurality of input nodes with each of the input nodes being coupled to a corresponding input voltage source which supplies a corresponding reference voltage to the individual gray-scale voltage generating circuit coupled thereto.

22. An LCD according to claim 21, wherein the value of the reference voltage is determined according to the color corresponding to the individual gray-scale voltage generating circuit coupled to the corresponding input voltage source.

23. An LCD according to claim 21, wherein the input nodes of each individual gray-scale voltage generating circuit are disposed therein according to the color corresponding to the individual gray-scale voltage generating circuit.

24. An LCD according to claim 21, wherein each individual gray-scale voltage generating circuit has a plurality of output nodes for generating the individual gray-scale voltages according to the reference voltages.

25. An LCD according to claim 24, wherein each individual gray-scale voltage generating circuit is a series of resistors with a plurality of connecting nodes.

26. An LCD according to claim 19, wherein the colors include red, green, and blue.

27. An LCD according to claim 26, wherein the individual gray-scale voltage generating circuits are:

a red gray-scale voltage generating circuit for generating a plurality of red gray-scale voltages;

a green gray-scale voltage generating circuit for generating a plurality of green gray-scale voltages; and a blue gray-scale voltage generating circuits for generating a plurality of blue gray-scale voltages;

wherein the gamma correction circuit outputs the pixel voltage corresponding to the pixel signal according to:

the common gray-scale voltages and the red gray-scale voltages when the pixel signal is used to display the color red;

the gamma correction circuit outputs the pixel voltage corresponding to the pixel signal according to the common gray-scale voltages and the green gray-scale voltages when the pixel signal is used to display the color preen; and the gamma correction circuit outputs the pixel voltage corresponding to the pixel signal according to the common gray-scale voltages and the blue gray-scale voltages when the pixel signal is used to display the color blue.

28. A gamma correction apparatus according to claim 19, wherein the corresponding pixel voltage is substantially equal to one of the common gray-scale voltages and the corresponding individual gray-scale voltages.

29. A gamma correction apparatus according to claim 19, wherein the common gray-scale voltage generating circuit comprises a series of resistors with a plurality of nodes, each individual gray-scale voltage generating circuit comprises a series of resistors, one end of the series of resistors of the respective individual gray-scale voltage generating circuits are connected together, and the connected ends of the series of resistors of the respective individual gray-scale voltage generating circuits are further connected to one node of the series of resistors of the common gray-scale voltage generating circuit.

* * * * *